US010094200B2

(12) United States Patent
Vangasse et al.

(10) Patent No.: US 10,094,200 B2
(45) Date of Patent: Oct. 9, 2018

(54) ACID INJECTION

(71) Applicant: Vetco Gray Controls Limited, Bristol (GB)

(72) Inventors: Anthony Jason Vangasse, Bristol (GB); Gareth Huw Lewis, Bristol (GB)

(73) Assignee: GE OIL & GAS UK LIMITED, Bristol (GB)

( * ) Notice: Subject to any disclaimer, the term of this patent is extended or adjusted under 35 U.S.C. 154(b) by 138 days.

(21) Appl. No.: 14/260,423

(22) Filed: Apr. 24, 2014

(65) Prior Publication Data

US 2014/0318797 A1 Oct. 30, 2014

(30) Foreign Application Priority Data

Apr. 24, 2013 (EP) ..... 13165140

(51) Int. Cl.
*E21B 37/06* (2006.01)
*E21B 33/038* (2006.01)
*E21B 41/00* (2006.01)

(52) U.S. Cl.
CPC ..... *E21B 37/06* (2013.01); *E21B 33/038* (2013.01); *E21B 41/0007* (2013.01)

(58) Field of Classification Search
CPC ..... E21B 37/06; E21B 33/038; E21B 41/0007
USPC ..... 166/335
See application file for complete search history.

(56) References Cited

U.S. PATENT DOCUMENTS 5,577,925 A * 11/1996 Schnatzmeyer ..... E21B 17/025 439/191
6,140,277 A * 10/2000 Tibbles ..... C09K 8/52 166/270.1
2011/0067876 A1* 3/2011 Turner ..... E21B 34/10 166/310
2011/0088909 A1* 4/2011 Hamblin ..... E21B 41/0007 166/340
2012/0279718 A1* 11/2012 Rocke ..... E21B 17/028 166/341

FOREIGN PATENT DOCUMENTS

GB 2473444 A 3/2013

OTHER PUBLICATIONS

European Search Report dated Apr. 10, 2013 which was issued in connection with EP Patent Application No. 13165140.8 which was filed on Apr. 24, 2013.

* cited by examiner

*Primary Examiner* — Matthew R Buck
*Assistant Examiner* — Patrick F Lambe
(74) *Attorney, Agent, or Firm* — GE Global Patent Operation

(57) ABSTRACT

A method of applying acid-wash to a subsea connection assembly, in particular a stabplate connection, in order to remove unwanted material such as marine growth and calcareous deposits. The method consists of inserting a plug, containing channels, into a central in a stabplate connection and injecting acid-wash through the plug. The plug may be carried by an operating tool arm of a remotely operated underwater vehicle (ROV).

18 Claims, 3 Drawing Sheets

ACID INJECTION

BACKGROUND OF THE INVENTION

The present invention relates to injecting acid-wash into a subsea connection assembly, in particular for removing unwanted material.

Electric and hydraulic power, chemical injection and communications are typically transmitted to subsea wells via an umbilical from a surface or land based platform, the umbilical being terminated at an umbilical termination assembly (UTA). The feeds for electric and hydraulic power and chemical injection are effected from the UTA to a well tree, which houses a well control system, by a multiplicity of self-sealing individual connectors. In order to facilitate mating or unmating of the electric and hydraulic power and chemical injection connectors subsea by a remotely operated underwater vehicle (ROV), they are typically mounted together on a plate known as a stabplate, so that a single ROV action mates all the connectors. Such a stabplate arrangement is normally reserved for the electric and hydraulic power and chemical injection feeds to the well. The ROV locates the stabplate to a fixed reciprocal plate mounted on the subsea tree, and, typically, a screw mechanism is operated by the ROV to force the two plates to mate and to lock them together. The mating and locking screw mechanism is, typically, part of the stabplate connection and remains subsea during the operation of the well. Unmating of the stabplate connection for maintenance/repair purposes involves an operation by an ROV of unscrewing the screw mechanism, which is designed to force the mated plates apart.

Leaving the screw mechanism subsea for lengthy periods of time can result in corrosion and contamination (e.g. biological growths) which can cause the screw mechanism to seize. The result is either the need for other forceful methods of separating the stabplate from the fixed plate (invariably resulting in expensive damage to the well tree and parts of the stabplate connection) or the additional cost of including a secondary release mechanism in the design of the stabplate connection. A similar problem occurs with calcareous deposits formed in subsea structures employing cathodic protection (CP) systems. Because of this, the stabplate connection and sub-components are often liberally doused with sulphamic based or hydrochloric based acid wash to break down the deposits and growth and enable mating and de-mating of the hydraulic connectors.

The current technique applied by some stabplate connection vendors is to create a cavity around the fixed plate by boxing in the area between the stabplate and fixed plate in order to pass acid wash into this area via a connector on the stabplate. This approach is typically used on stabplate connections with a central screw-thread to mate/de-mate the plates. The disadvantage of this arrangement is that this means a specific design must be used for such applications, with the extra cost and mass involved in the extra material. Furthermore, this means an ROV needs to make up a hot-stab (i.e. a high pressure subsea quick dis-connector) with every stabplate to deploy the acid-wash.

However, modern improvements to stabplate design, e.g. the design disclosed in GB-A-2473444, allow for the removal of the central mating and locking screw mechanism (which additionally provides the benefit of removing part of the mechanism which is prone to calcareous deposit) and thus after mating leaving a central opening in the stabplate connection. This central opening permits application of the present invention, which removes the disadvantages of existing systems detailed above, and provides a much more directed and efficient acid application to remove deposits and growths.

SUMMARY OF THE INVENTION

According to the present invention from one aspect, there is provided a method of applying acid-wash to a subsea connection system comprising a removable plate attached by attachment means to a fixed plate to define a central opening, the method comprising the steps of:

inserting a plug, containing at least one channel, into the central opening to seal the opening; and injecting acid-wash into the opening from the at least one channel.

The attachment means could define a cavity into which the acid-wash is injected.

The step of inserting the plug could be carried out by a remotely operated underwater vehicle. In this case, a surface of the remotely operated underwater vehicle could abut against the attachment means to seal such a cavity prior to the step of injecting acid-wash into the at least one channel.

The plug further could comprise a sealing ring for sealing the opening.

Typically, the removable plate carries connectors which are mated with connectors carried by the fixed plate. In this case, acid-wash could be forced through channels in the removable plate to the connectors.

According to the present invention from another aspect, there is provided an apparatus comprising a subsea connection system which comprises a removable plate attached by attachment means to a fixed plate to define a central opening, the apparatus further comprising a plug for sealing the opening, containing at least one channel into which acid-wash is injected in use.

The attachment means could define a cavity into which the acid-wash can be injected.

The plug could be insertable into the opening by a remotely operated underwater vehicle. In this case, a surface of the remotely operated underwater vehicle can abut against the attachment means to seal such a cavity prior to the injecting of acid-wash into the at least one channel.

The plug could further comprise a sealing ring for sealing the opening.

Typically, the removable plate carries connectors which are mated with connectors carried by the fixed plate. In this case, the removable plate could comprise channels through which acid-wash can be forced to the connectors.

The present invention also comprises a subsea structure incorporating apparatus according to an embodiment of the invention.

DETAILED DESCRIPTION OF THE EXEMPLARY EMBODIMENTS OF THE INVENTION

Figure 1:
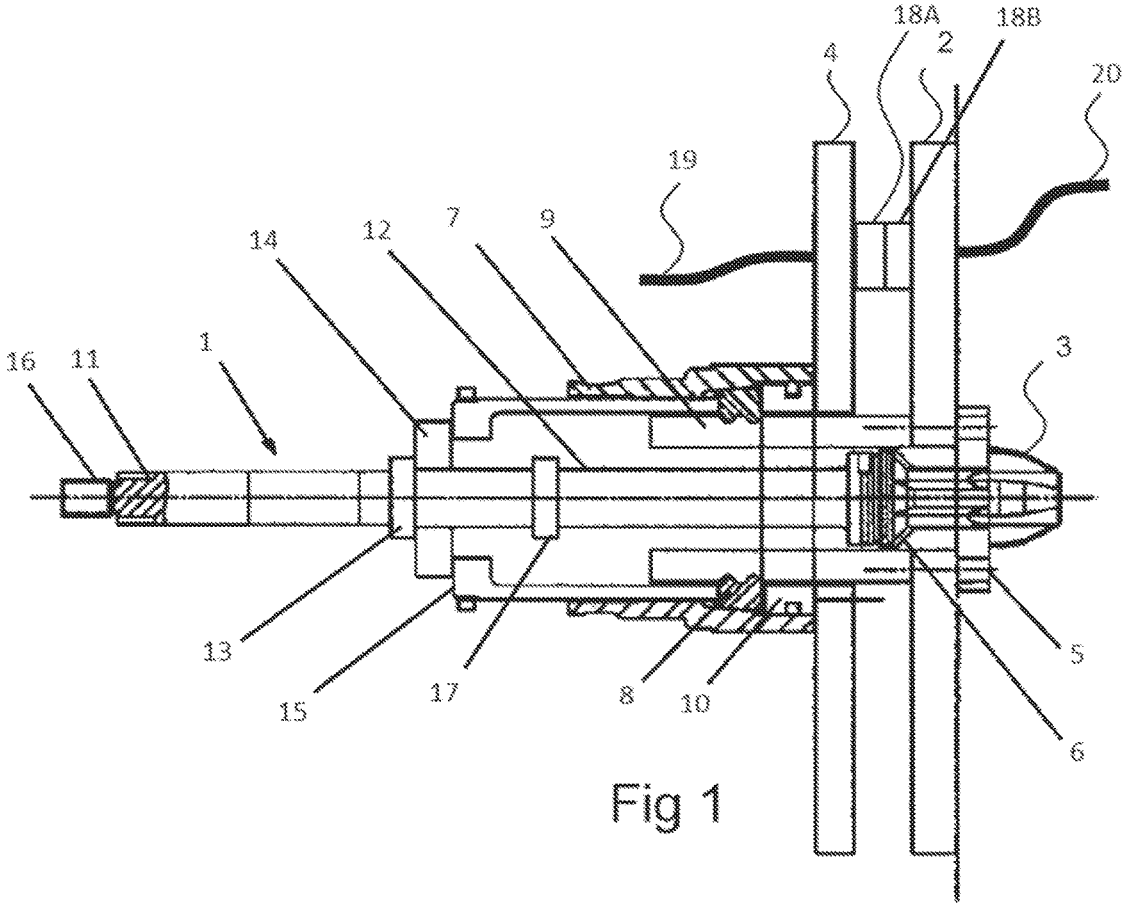
FIG. 1 illustrates an arrangement for providing a stabplate connection.

FIG. 1 shows a stabplate connection resulting from the teachings of GB-A-2473444, after completion of the mating of the plates as a result of mating of connectors carried by the plates. A retrievable tooling package 1 has been locked to a fixed plate 2 with a chamfered end 3 of the tooling package engaged with a stabplate 4 via an anchor block 5 and a tapered end portion 6 received in the tapered entrance to the orifice of anchor block 5. A bayonet locking collar 7 has been pushed forward, so that locking dogs 8 are forced to engage with grooves in tube 9, which is carried by fixed plate 2. The bayonet locking collar 7 has then been rotated to engage bayonet pins into a bayonet locking pin locator 10, thus mating the stabplate 4 to fixed plate 2. Subsequently, a threaded shaft 11 is rotated to unscrew from a tube 12 so that the force on the collar 13 and the latching/de-latching plate 14 on a dog support cage 15 is released, thus allowing a square-ended shaft 16 to be rotated by about minus 45 degrees, thus permitting release of the chamfered end 3 of the retrievable tooling package 1 and permitting its withdrawal from the mated stabplate 4 and fixed plate 2, the result being as shown in FIG. 2.

The stabplate 4 may be separated from the fixed plate 2 by unscrewing the threaded shaft 11 from the tube 12, whereby the collar 17, attached to the tube 12, presses against the latching/de-latching plate 14, and thus the inside surface of the dog support cage 15, thus forcing the stabplate 4 and fixed plate 2 apart. Removal of the stabplate 4, along with the retrievable tooling package 1 is finally achieved by the rotation of the square-ended shaft 16, to disengage the chamfered end 3 from the anchor block 5 and withdrawing the assembly. If necessary the tooling package 1 is returned to the surface using the ROV.

Fixed plate 2 is typically attached to a fixed structure such as a subsea well Christmas tree (not shown), and is mated with removable stabplate 4, this having been achieved by operation of the mating mechanism as described above. The typically circular plates 4 and 2 each carries a multiplicity of wet mateable connectors 18A and 18B respectively (which can be a mixture of hydraulic, chemical or electrical), only one of each being shown for simplicity. Connectors 18A have been mated with connectors 18B to mate the plates 4 and 2 to each other, and via mated pairs of connectors 18A and 18B, external sources can be connected to the fixed structure, with an input cable or pipe 19 and feed 20 to the structure. As described above, after the stabplate 4 has been mated to the fixed plate 2 the retrievable tooling package 1 is removed by the ROV leaving an opening 21 at the centre of the plates.

Figure 2:
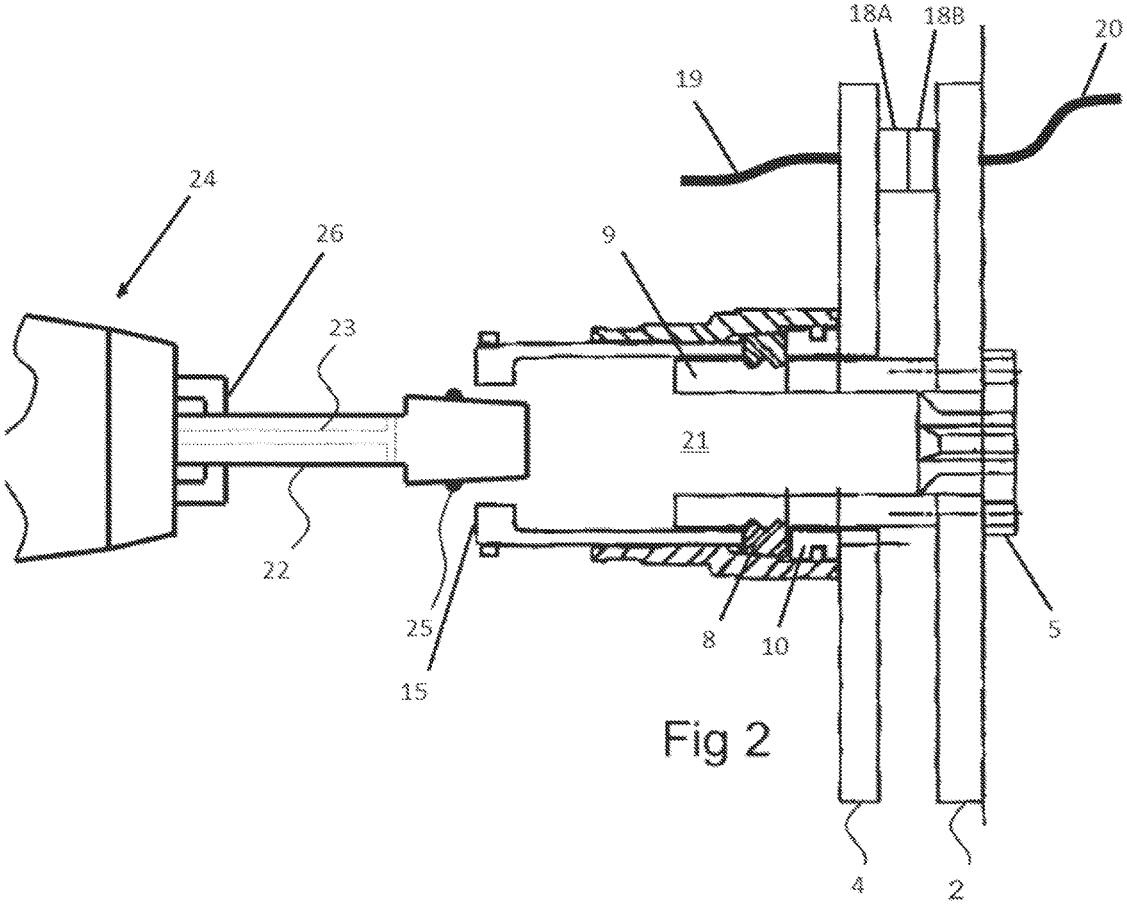
FIGS. 2-3 show steps for applying acid-wash to the stabplate connection of FIG. 1, in accordance an embodiment of a method of the present invention.

FIG. 2 shows a plug 22, with internal channels 23, shown by dotted lines, drilled in it to permit acid to flow from a supply from a ROV 24 into the stabplate connection, and fitted with a circular sealing ring 25. The plug is held by a tool operating arm of the ROV 24 which inserts it into the central opening 21.

Figure 3:
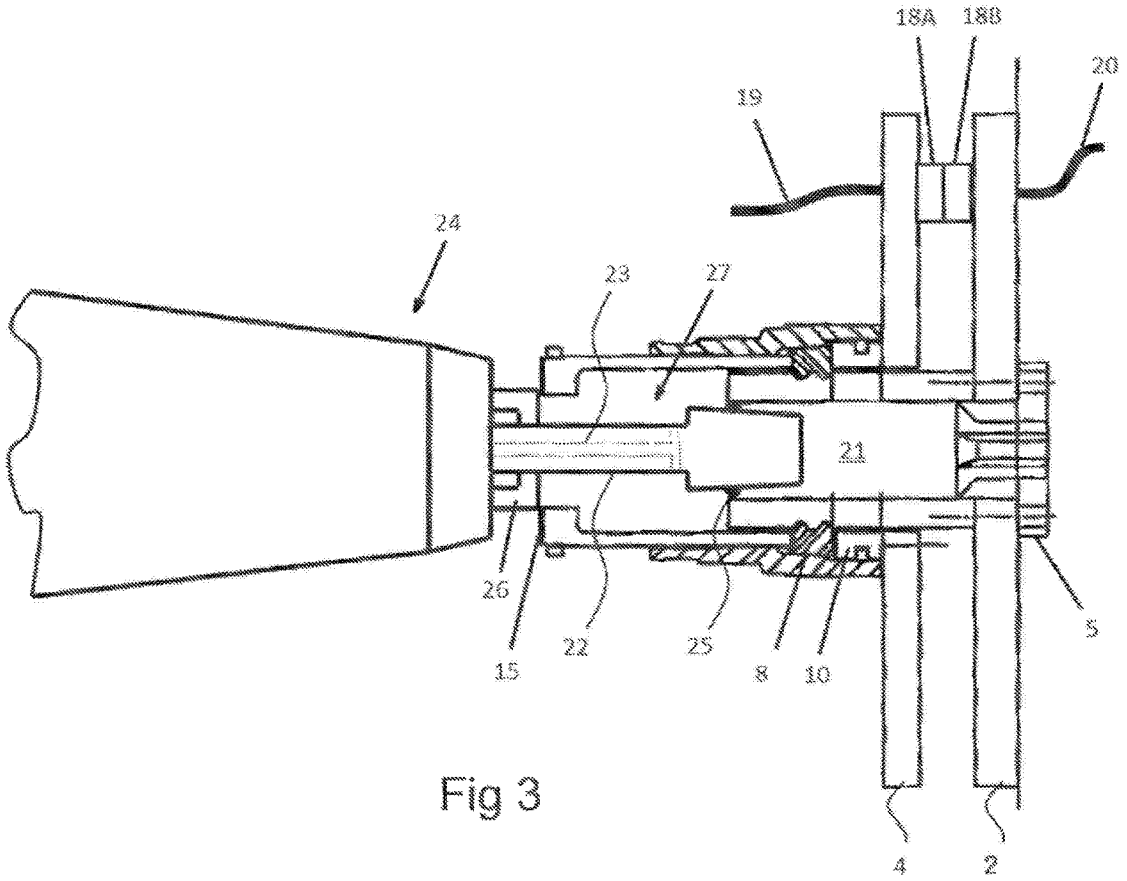

FIG. 3 shows the plug 22 located in the centre of the stabplate 4 and fixed plate 2, with the central opening 21 sealed by a sealing ring 25 of the plug 22 and a front face 26 of the tool operating arm of the ROV 24 abutting against the back of dog support cage 15 in order to seal a cavity 27. This enables the ROV to inject the acid-wash in a targeted manner to the required areas, e.g. the annulus surrounding tube 9, the grooves with which locking dogs 8 engage. Due to the sealed nature of the cavity 27, the acid-wash is forced into the operating parts of the stabplate connection and, through built-in channels in the stabplate 4, to the connector pairs 18. In this configuration the cavity 27 is defined by the attachment means by which the stabplate 4 is attached to fixed plate 2, and the opening is sealed by the sealing ring 25 of the plug 22.

Advantages of Using the Invention

Embodiments of the present invention enable plates and subcomponents to be thoroughly flushed, in particular, the small volume cavities prone to complete build-up of marine or calcareous growth. This provides the benefit over existing systems of making much more effective, economic, and environmental friendly, use of the acid.

Furthermore, the plug may be carried by an ROV and used over and over without having to return to the surface or make up multiple hot stabs to the stabplate connections. This may be done on a periodic maintenance schedule to minimise the opportunity for calcareous deposits or marine growth to build up.

The need is much reduced for changes to the stabplate connection design, to mitigate calcareous and marine growth, such as building boxed-in cavities around the plates. The same stabplate connection design may be used for every application and the acid-wash delivery plug tool is used where necessary.

The written description uses examples to disclose the invention, including the best mode, and also to enable any person skilled in the art to practice the invention, including making and using any device or system and performing the incorporated method. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial difference from the literal language of the claims.

What is claimed is:

1. A method of applying acid-wash to a subsea connection system, wherein the subsea connection system comprises a removable plate attached by an attachment to a fixed plate to define a central opening, the method comprising:

inserting a plug, comprising at least one channel and a sealing ring, into the central opening to seal the central opening by the sealing ring, the attachment further defining a cavity with the sealing ring of the plug, such that the cavity, into which the acid-wash is injected, is adjacent to the sealed central opening;

sealing the cavity; and subsequently, injecting the acid-wash into the at least one channel.

2. The method according to claim 1, wherein the step of inserting the plug is carried out by a remotely operated underwater vehicle.

3. The method according to claim 2, wherein the attachment defined cavity into which the acid-wash is injected, and wherein a surface of the remotely operated underwater vehicle abuts against the attachment to seal the cavity prior to the step of injecting the acid-wash into the at least one channel.

4. The method according to claim 1, wherein the removable plate carries connectors mated with connectors carried by the fixed plate.

5. The method according to claim 4, wherein the acid-wash is forced through channels in the removable plate to the connectors.

6. The method of claim 1, wherein injecting the acid-wash is in a targeted manner.

7. A method of applying acid-wash to a subsea connection system, wherein the subsea connection system comprises a removable plate attached by an attachment to a fixed plate to define a central opening, the method comprising:

inserting a plug, comprising at least one channel and a sealing ring, into the central opening to seal the central opening by the sealing ring; and injecting the acid-wash into the at least one channel, wherein:

the step of inserting the plug is carried out by a remotely operated underwater vehicle, and the attachment with the sealing ring of the plug defines a cavity, such that the cavity, into which the acid-wash is injected, is adjacent to the sealed central opening, wherein a surface of the remotely operated underwater vehicle abuts against the attachment to seal the cavity prior to the step of injecting the acid-wash into the at least one channel.

8. The method according to claim 7, wherein the removable plate carries connectors mated with connectors carried by the fixed plate.

9. The method according to claim 8, wherein the acid-wash is forced through channels in the removable plate to the connectors.

10. The method of claim 7, wherein injecting the acid-wash is in a targeted manner.

11. An apparatus, comprising:

a subsea connection system comprising a removable plate attached by an attachment to a fixed plate to define a central opening; and a plug comprising at least one channel into which acid-wash is injected in use and a sealing ring to seal the central opening, a cavity defined by the attachment and the sealing ring of the plug into which the acid-wash can be injected and the cavity is adjacent to the sealed central opening; and wherein the cavity is sealed prior to injecting the acid-wash into the at least one channel.

12. The apparatus according to claim 11, wherein a surface of a remotely operated underwater vehicle can abut against the attachment to seal the cavity prior to the injecting of the acid-wash into the at least one channel.

13. The apparatus according to claim 11, wherein the removable plate carries connectors mated with connectors carried by the fixed plate.

14. The apparatus according to claim 13, wherein the removable plate comprises channels through which acid-wash can be forced to the connectors.

15. A subsea structure incorporating the apparatus of claim 11.

16. The apparatus according to claim 11, wherein:

the plug is insertable into the central opening by a remotely operated underwater vehicle, and a surface of the remotely operated underwater vehicle can abut against the attachment to seal the cavity prior to the injecting of the acid-wash into the at least one channel.

17. The apparatus according to claim 16, wherein the removable plate carries connectors mated with connectors carried by the fixed plate.

18. The method of claim 11, wherein the acid-wash is injected in a targeted manner.

* * * * *